United States Patent [19]

Irino et al.

[11] Patent Number: 4,527,527

[45] Date of Patent: Jul. 9, 1985

[54] APPARATUS FOR CONTROLLING OPENING ANGLE OF THROTTLE VALVE ON COMPLETE FIRING

[75] Inventors: Hiroshi Irino; Tomio Aoi, both of Saitama, Japan

[73] Assignee: Honda Giken Kogyo Kabushiki Kaisha, Tokyo, Japan

[21] Appl. No.: 571,889

[22] Filed: Jan. 18, 1984

[30] Foreign Application Priority Data

Jan. 27, 1983 [JP] Japan ..... 58-10518

[51] Int. Cl.[3] ..... F02M 1/10

[52] U.S. Cl. ..... 123/438; 123/179 G

[58] Field of Search ..... 123/179 G, 179 L, 362, 123/437, 438

[56] References Cited

U.S. PATENT DOCUMENTS 4,383,506 5/1983 Atago et al. ..... 123/179 G

FOREIGN PATENT DOCUMENTS 2757146 6/1978 Fed. Rep. of Germany ... 123/179 G 132431 10/1981 Japan ..... 123/362

2064009 6/1981 United Kingdom ..... 123/362

*Primary Examiner*—Tony M. Argenbright

*Attorney, Agent, or Firm*—Pollock, Vande Sande and Priddy

[57] ABSTRACT

An apparatus is disclosed for controlling an opening angle or a position of a throttle valve on complete firing in an internal combustion engine until the said engine has shifted to a situation of warm-up after the said engine started and the complete firing thereof was sensed. The control apparatus is so constructed that the throttle valve is closed at high speed to a predetermined opening angle which has an intermediate value between a starting position and a warming-up position when complete firing of the engine is sensed, and thereafter the throttle valve is driven to close until it reaches the warming-up position at a relatively low speed.

3 Claims, 10 Drawing Figures

| |
|---|
| FIG. 3A |
| FIG. 3B |
| FIG. 3C |

| FIG. 4A | FIG. 4B | FIG. 4C |
|---|---|---|

APPARATUS FOR CONTROLLING OPENING ANGLE OF THROTTLE VALVE ON COMPLETE FIRING

BACKGROUND OF THE INVENTION (1) Field of the Invention

This invention relates to an apparatus for controlling an opening angle (or position) of a throttle valve on complete firing in an internal combustion engine, and particularly to an apparatus for controlling the opening angle of a throttle valve on complete firing until the internal combustion engine has shifted to a situation of warming up after the engine started and the complete firing was sensed.

(2) Description of the Prior Art

Heretofore, it has been proposed to provide a carburetor comprising a throttle valve disposed in an intake barrel of the carburetor, a choke valve disposed on the upstream side thereof, a motor driving said valves, and means for detecting the temperature and rotational speed of the engine, the opening angles of the throttle valve and the choke valve being appropriately established and controlled in response to temperature at the time of starting and warming up the engine (for example, see Japanese Patent Application No. 38165/1982.

An example for controlling opening angles of a throttle valve and a choke valve in such carburetors is illustrated in FIG. 1 wherein time is plotted as the abscissa and opening angles of the throttle valve and the choke valve as the ordinate, in which line SV designates the throttle valve and line CV designates the choke valve.

As is apparent from FIG. 1, two valves are held at their starting positions (starting opening angles), more specifically, the throttle valve and the choke valve are maintained at substantially full opened position Th 1 and substantially full closed position, respectively, immediately after turning on a starter switch of the engine at time T0.

Then, when complete firing of the engine is sensed at time T1, both the valves are moved quickly to warming-up positions (the choke valve CV is rushed to substantially full opened position TH1, while the throttle valve SV is rushed to position Th 3 which has previously been fixed in response to temperatures of the engine) at time T2 after the elapse of a predetermined delay time from the time T1.

In such a method for controlling opening angles of a throttle valve and a choke valve in conventional carburetors, when the engine reaches its complete firing state, the throttle valve is rapidly closed, while the choke valve is rapidly fully opened, so that the air fuel ratio of the mixture decreases suddenly.

For this reason, explosion energy of the engine decreases sharply, and in addition the relieving effect of the choke valve becomes temporarily excessive. Thus, conventional carburetors have the disadvantage that the engine is liable to stall in case of the complete firing.

As a countermeasure for the disadvantage mentioned above, it may be considered that each rate of change in both the valves is moderated (for example, the period of time required for decreasing the opening angle of the throttle valve from position Th 1 to position Th 3 is prolonged).

In case of a controlling method such as described above, however, the air fuel ratio of the mixture becomes excessive, and plugs are apt to be wetted so that the disadvantage remains that the engine is apt to stall on the complete firing.

BRIEF SUMMARY OF THE INVENTION

The present invention eliminates the aforementioned disadvantage, and an object of the invention is to provide an apparatus for controlling the opening angle of a throttle valve on complete firing by which state of complete firing in an engine can be shifted smoothly to warming-up state, whereby the occurence of stall on the complete firing can be prevented.

In order to attain the aforesaid object, the present invention provides a control apparatus that is so constructed that the throttle valve is closed at high speed to a predetermined opening angle which has an intermediate value between the starting position and the warming-up position at the time when complete firing of the engine is sensed, and thereafter the throttle valve is driven so as to close at a comparatively low speed until the throttle valve reaches the warming-up position.

BRIEF DESCRIPTION OF THE DRAWINGS

FIG. 4 shows how to incorporate FIGS. 4A, 4B and 4C; and

FIGS. 4A, 4B and 4C together constitute a flowchart illustrating an example of how the present invention can be practiced by utilizing a computer or the like.

DETAILED DESCRIPTION OF THE PREFERED EMBODIMENT

Figures 3, 3A:
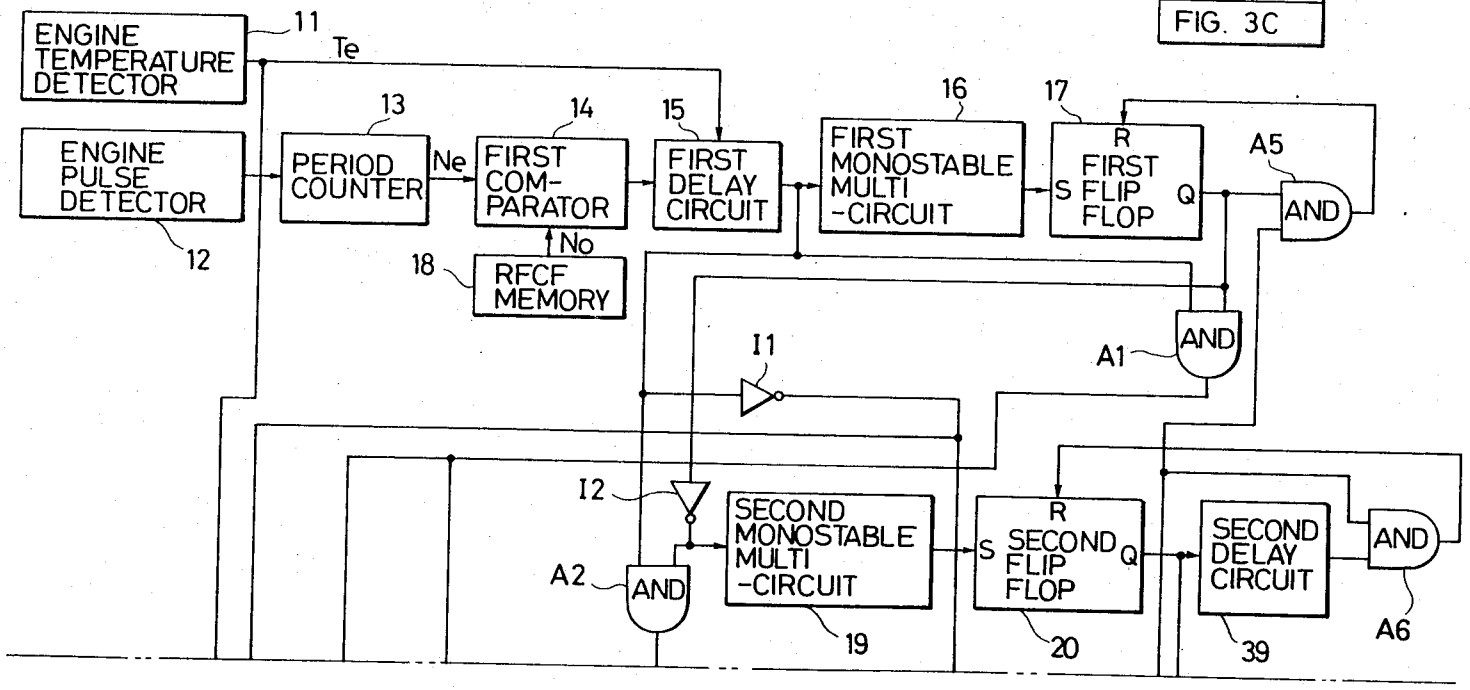
FIG. 3 shows how to incorporate FIGS. 3A, 3B and 3C.
FIGS. 3A, 3B and 3C together constitute a block diagram illustrating an embodiment of the present invention.
Figure 3B:
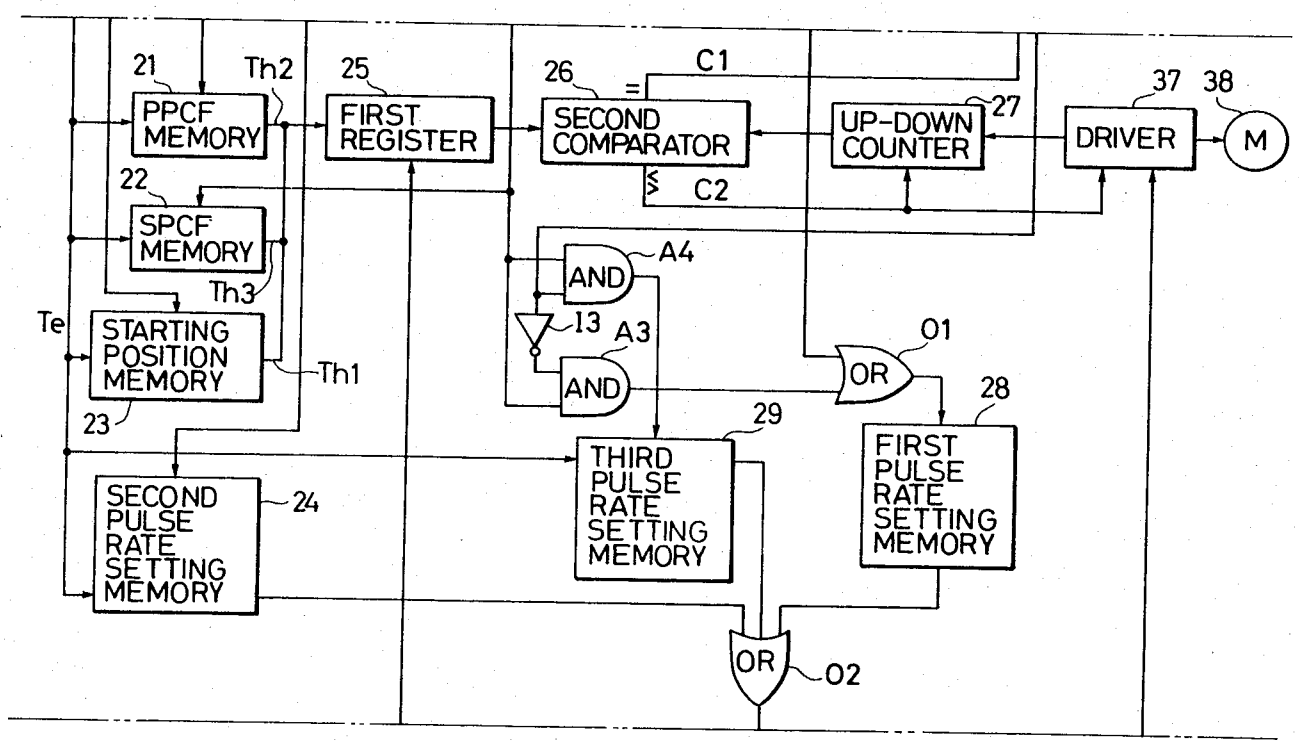
Figure 3C:
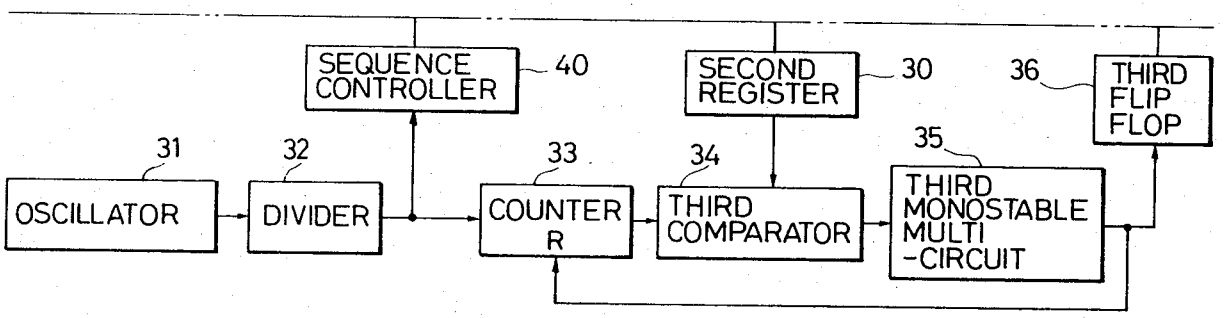

The present invention will be described in detail hereinbelow by referring to the accompanying drawings wherein FIGS. 3A–3C are a block diagram illustrating an embodiment of the invention.

In FIGS. 3A–3C, an engine temperature detector 11 detects a temperature of an engine, and the result obtained is supplied to a first delay circuit 15, a memory 21 for primary position of a throttle valve on complete firing (hereinafter referred to simply as "PPCF memory"), a memory 22 for secondary position of the throttle valve on complete firing (hereinafter referred to simply as "SPCF memory"), a starting position memory 23, a second pulse rate setting memory 24, and a third pulse rate setting memory 29, respectively.

An engine pulse detector 12 detects engine pulses generated in response to rotations of the engine. The aforesaid engine pulses are counted by a period counter 13 and supplied to a first comparator 14 after converting the engine pulses into rotational frequency signal Ne of the engine.

The first comparator 14 compares decision constant of complete firing (hereinafter referred to simply as "CF decision constant") N0 stored in a memory 18 for setting rotational frequency on complete firing (hereinafter referred to simply as "RFCF memory") with said rotational frequency signal Ne to produce output "1" in the case where the rotational frequency signal is larger than the CF decision constant, in other words, the engine has reached the complete firing state.

On the other hand, when the rotational frequency signal Ne is smaller than the CF decision constant NO, in other words, if the engine has not yet reached the complete firing state, the comparator 14 produces output "0".

In the early stage of starting the engine, the output of the first comparator 14 is "0", and this output "0" is supplied to an invertor I1 through the first delay circuit 15. As a result, the output of the invertor I1 turns into "1" so that the starting position memory 23 is selected.

The output of said invertor I1 is concurrently applied to a first pulse rate setting memory 28 through an OR circuit 01 to select it. The first pulse rate setting memory 28 stores a pulse rate for deciding the speed of revolution of a motor 38 as described hereinafter.

On one hand, a signal of a predetermined constant frequency produced by an oscillator 31 is divided by means of a divider 32 to be applied to a counter 33. A third comparator 34 compares the value counted in the counter 33 with the stored value in a second register 30 so that a third monostable multi-circuit 35 is triggered by the result which is obtained at the time when both the said values are equal to each other. The output pulse from the monostable multi-circuit 35 is supplied to a third flip flop 36 and at the same time, it is utilized to reset the counter 33. Accordingly, the period (or frequency) of the third monostable multi-circuit 35 becomes a function of the value stored in the second register 30.

As mentioned above, the first pulse rate setting memory 28 is selected, and the pulse rate thereof has been stored in the second register 30 by way of an OR circuit 02. As a result, the period of the output pulse from the third monostable multi-circuit 35 is determined by the pulse rate stored in the first pulse rate setting memory 28.

The third flip flop 36 reverses the output thereof in response to every supply of output from the third monostable multi-circuit 35, and the output of said third flip flop 36 is supplied to a driver 37 as a motor driving pulse for driving the motor 38.

The driver 37 drives the motor 38 on the basis of said pulse, and at the same time the same pulse is supplied to an up-down counter 27. Thus, the up-down counter 27 represents correctly the present position (or rotational angle) of the motor 38.

In accordance with the operational sequence described above, when the ignition switch of the engine is turned on, the throttle valve is rapidly shifted to starting position Th 1 substantially a full opened position in most cases) at once. At this time, a choke valve is shifted to a substantially full closed position, and the choke valve is maintained at the same position until the engine reaches a state of complete firing.

When the rotational frequency signal Ne of the engine reaches the set point NO or higher value of the RFCF memory 18, it is decided that the engine is in the complete firing state.

At this moment, the first comparator 14 produces output "1", and this output "1" is supplied to the invertor I1, a first monostable multi-circuit 16, and AND circuits A1 and A2, respectively, after the output "1" is delayed in the first delay circuit 15.

Further, to be noted is that the delay time in said first delay circuit 15 is a function of engine temperatures, and it is arranged that the lower engine temperature provides the longer delay time as disclosed in, for example, Japanese Patent Laid-open No. 155256/1983.

The reason why the first delay circuit 15 is provided herein is that when the complete firing state is allowed to shift to the warming-up state by closing the throttle valve and opening the choke valve immediately after the engine reaches the complete firing state, the change in air fuel ratio (degree of decrease) becomes excessive so that it is liable to cause stoppage of the engine (so-called stall on the complete firing).

The AND circuits A1 and A2 are opened by means of the output "1" from the first delay circuit 15 and at the same time, the first monostable multi-circuit 16 is triggered thereby. A first flip flop 17 is set by means of the output from the first monostable multi-circuit 16, and the resulting output Q becomes "1".

The output from the AND circuit A1 rises, and as a result the PPCF memory 21 and the second pulse rate setting memory 24 are selected, while since the output of the invertor I1 falls to "0", there is not such a case where the starting position memory 23 and the first pulse rate setting memory 28 are selected.

Under the circumstances, as is easily understood from the foregoing description, the third flip flop 36 produces motor driving pulses in accordance with a period determined by a value stored in the second pulse rate setting memory 24, and the resulting motor driving pulses are supplied to the driver 37.

The output from the PPCF mmemory 21 (i.e., primary position on complete firing Th 2) is stored in the first register 25, and the same value is supplied to the second comparator 26.

The second comparator 26 compares the value counted in the up-down counter 27 (i.e., present position of the motor 38) with the value stored in the first register 25, so that the second comparator 26 outputs either signal C1 in the case where the values are equal to each other, or signal C2 in the case where the values are not equal to each other.

Figure 1:
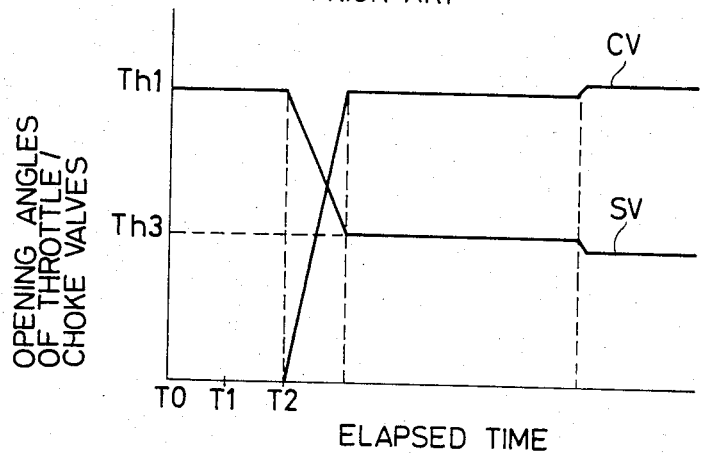
FIG. 1 PRIOR ART
FIG. 1 is a graphic representation indicating the state of change with time in respect of the opening angles of a throttle valve and a choke valve in a conventional example during a period of time from starting the engine to warming up it.
Figure 2:
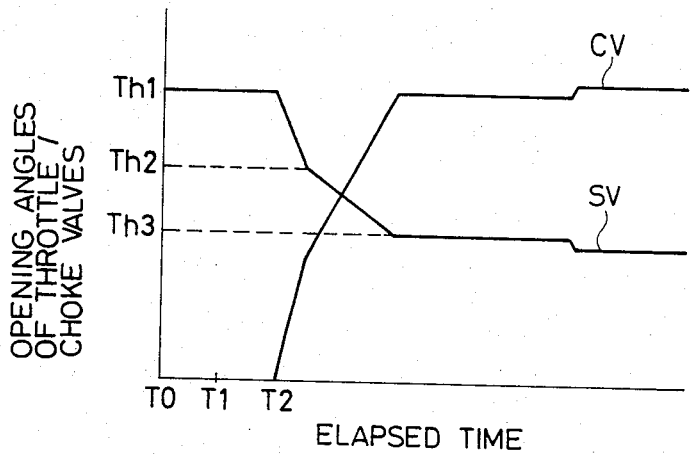
FIG. 2 is a graphic representation indicating the state of change with time in respect of the opening angles of a throttle valve and a choke valve in an example of the present invention during a period of time from starting the engine to warming up it.

In the above case, as is apparent from FIG. 2, since the primary position on complete firing Th 2 is smaller than the value counted in the up-down counter 27 (in other words, the target position Th 2 is smaller than the present position of the throttle valve), the second comparator 26 produces the signal C2.

As a result, the driver 37 rotates the motor 38 towards the direction of closing the throttle valve at a relatively high speed on the basis of the motor driving pulses from the third flip flop 36. With rotation of the motor 38, the throttle valve closes, and when the present position of the throttle valve becomes equal to the target position Th 2, the second comparator 26 extinguishes the signal C2 and generates the signal C1.

The aforesaid signal C1 is supplied to AND circuits A5 and A6, and the first flip flop 17 is reset by means of the output "1" from the AND circuit A5. Thus, the output of the AND circuit A1 falls so that selection of the PPCF memory 21 and the second pulse rate setting memory 24 is finished.

On the other hand, the output Q (i.e., "0") from the first flip flop 17 is reversed by an inverter I2, and it is supplied to the AND circuit A2 and a second monostable multi-circuit 19. The output from the AND circuit A2 becomes "1" so that it selects the SPCF memory 22 and at the same time, opens AND circuits A3 and A4.

The second monostable multi-circuit 19 is triggered by the output "1" from the invertor I2 so that the second flip flop 20 is set, and its output Q turns to "1". The output "1" from the second flip flop 20 is supplied to the third pulse rate setting memory 29 through the AND circuit A4 to select it.

In these circumstances, the throttle valve is further shifted to a secondary position on complete firing Th 3 which is stored in the SPCF memory 22 as the target value, along its closing direction at a relatively low rate decided by the set point of the third pulse rate setting memory 29.

The output "1" from the second flip flop 20 is supplied to the AND circuit A6 through the second delay circuit 39 to open it, but output signal C1 of the second comparator 26 disappears at this moment so that the output from the AND circuit A6 remains "0".

The throttle valve is further driven towards the closing direction and when a position of the throttle valve becomes equal to the secondary position on complete firing Th 3, the output of the AND circuit A6 rises to reset the second flip flop 20, so that its output Q turns to "0".

Hence, the output from the AND circuit A4 falls to complete selection of the third pulse rate setting memory 29, while the output of the AND circuit A3 rises in accordance with output "1" from an invertor I3, whereby the first pulse rate setting memory 28 is selected.

In view of the above, thereafter the throttle valve is controlled in an opening or closing manner towards the secondary position on complete firing Th 3 (i.e., warming-up position) derived from the SPCF memory 22 as the target value at a rate determined by the set point of the first pulse rate setting memory 28.

Further a sequence controller 40 functions to reset the first register 25 every predetermined moment and to supply the memory contents read selectively from the respective memories 21–23 to the second comparator 26.

As is clear from FIG. 3, since the data read from the SPCF memory 22 depends on the engine temperature as a parameter, pertinent control of warming up is thereafter executed.

Figures 4, 4A:
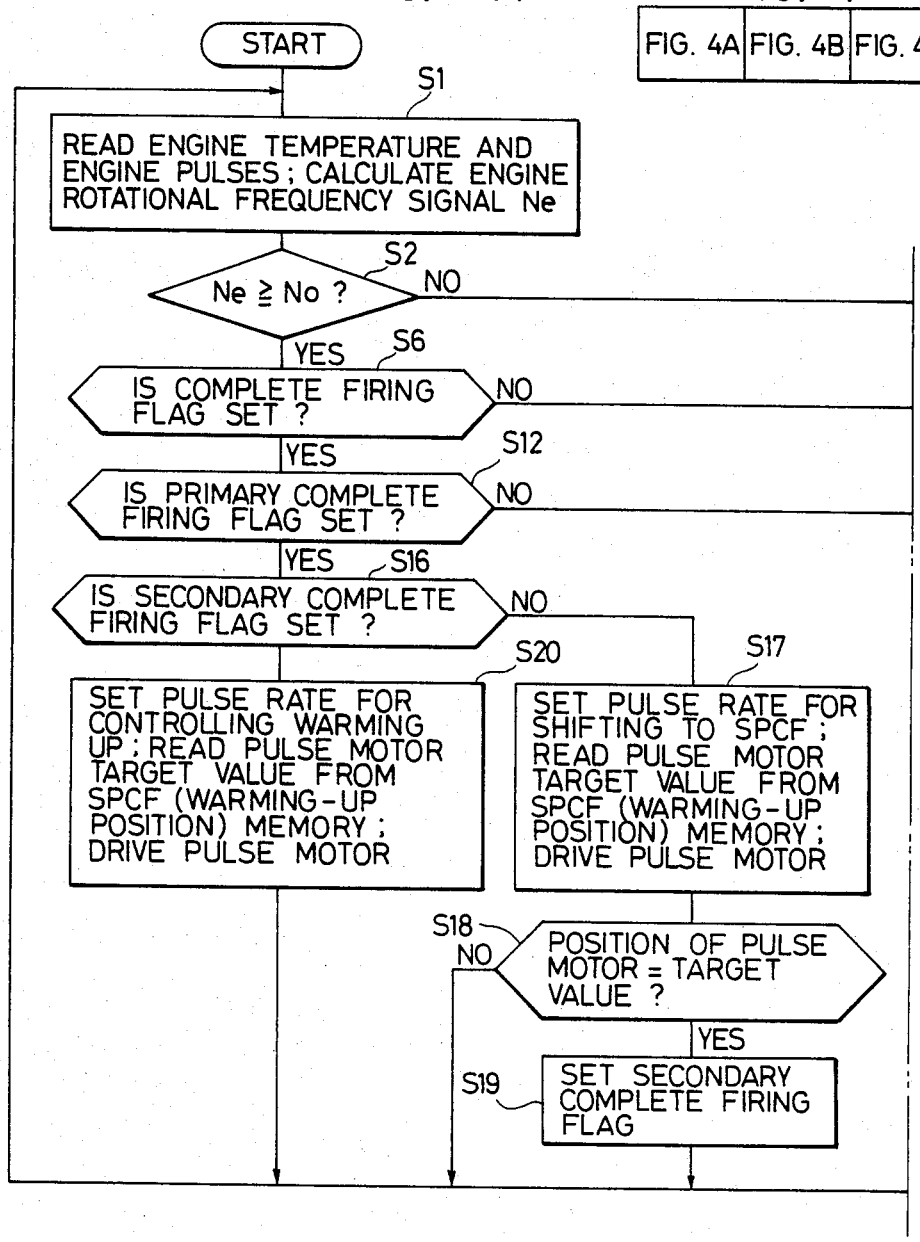
Figure 4B:
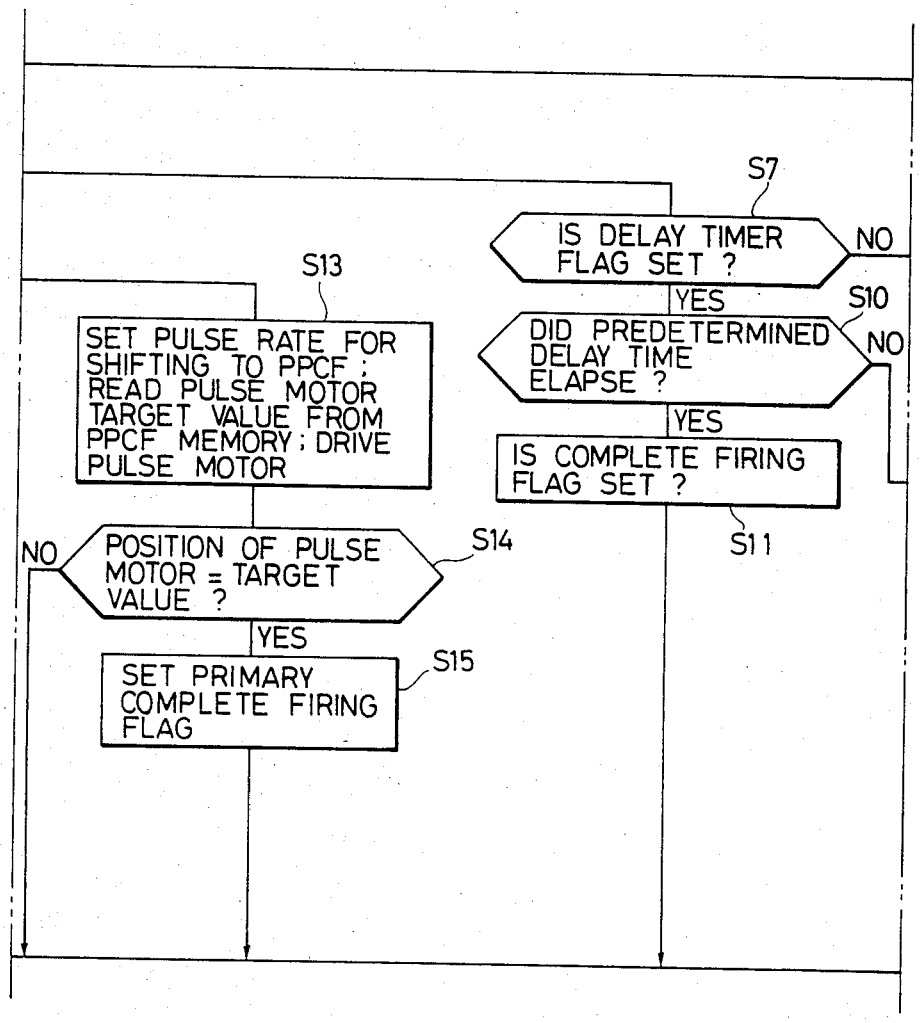
Figure 4C:
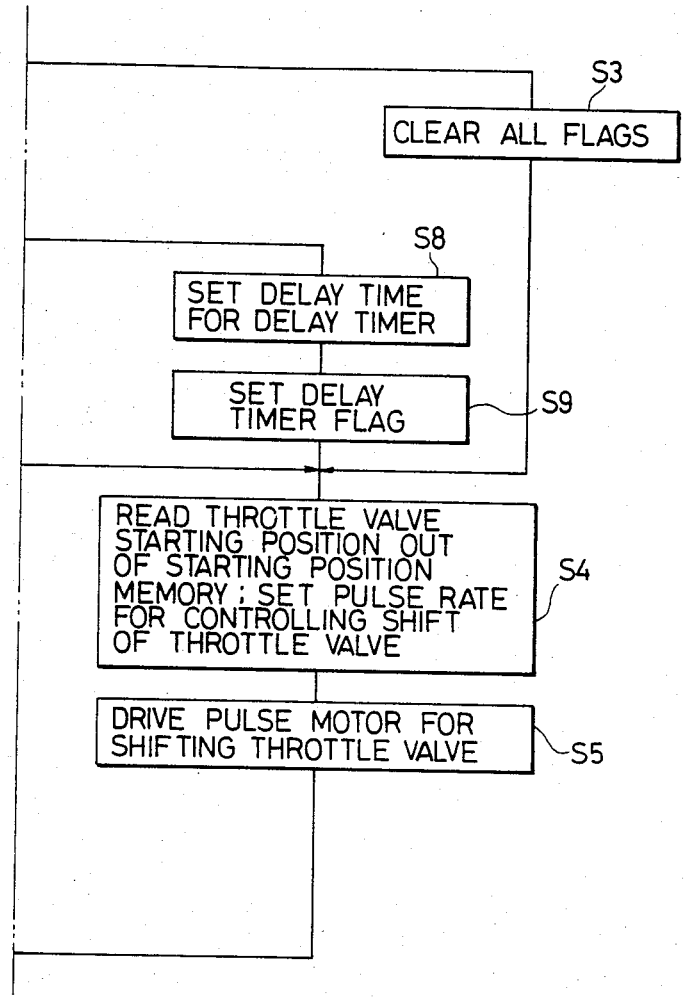

In the above embodiment, although the present invention has been described with reference to the case where the invention is practiced in the form of so-called hardware or a wired-logic by combining various kinds of logic circuits, the present invention can also be embodied in the form of so-called software by utilizing a computer or the like. Next, steps of procedure for practicing the invention by means of a computer will be described by referring to the flowchart illustrated in FIGS. 4A, 4B and 4C.

Step S1 . . . When the ignition switch of an engine is turned on, the system starts, and first, engine temperature and engine pulses are read to operate rotational frequency signal Ne in the step S1.

Step S2 . . . Judgment is effected as to whether or not the rotational frequency signal Ne operated in the preceding step S1 is larger than CF decision constant N0, in other words, whether or not the engine has been in a state of complete firing. In the early stage, the answer is negative so that the procedure proceeds to step S3.

Step S3 . . . All flags (flags of delay timer, complete firing, primary complete firing and secondary complete firing in this case) are cleared or reset.

Step S4 . . . Starting position of a throttle valve is set and at the same time, control pulse rate for shifting a position of the throttle valve to said starting position is set. (This situation corresponds to the selection of the starting position memory 23 and the first pulse rate setting memory 28 in FIGS. 3A–3C.)

Step S5 . . . The throttle valve is shifted to the position of starting opening angle at a rotational speed corresponding to the pulse rate selected in the preceding step S4.

Thereafter, the procedure for processing returns to the steps S1 and S2. Then, the processing circulates through the steps S1→S2→S3→S4→S5→S1 until the judgment in the step S2 is affirmative (that is, until the engine reaches the complete firing state).

Step S6 . . . When the engine reaches the complete firing state in which the judgment in the step S2 may be positive, the processing begins to proceed to the step S6 so that it is decided whether complete firing flag has been set or not. Immediately after the engine reached the complete firing state, the complete firing flag remains reset in the preceding step S3 so that such decision fails to be positive, and the processing proceeds to step S7.

Step S7 . . . It is judged whether or not the delay timer flag is set. In the early stage, such judgment is negative so that the processing proceeds to step S8.

Step S8 . . . A predetermined delay time is set in the delay timer by utilizing the engine temperature read in the step S1 as a parameter.

Step S9 . . . The delay timer flag is set. And the processing proceeds to the steps S4 and S5.

The procedure for processing proceeds again from the step S1 to the step S2 as well as the step S6→step S7. Since the judgment in the step S7 can be positive this time, the processing proceeds further to step S10.

Step S10 . . . It is decided whether or not the delay time set in the preceding step S8 has already elapsed. Before the elapse of the delay time, the processing circulates through a loop of the steps S10→S4→S5→S1→S2→S6→S7→S10.

Step S11 . . . When the judgment in the preceding step S10 is positive, the procedure proceeds to the present step to set the complete firing flag, so that it is decided that the engine has perfectly reached the complete firing state.

In other words, the judgment in the step S6 becomes positive so that the procedure proceeds to step S12.

Step S12 . . . Judgment is effected as to whether the flag on the primary complete firing has been set or not. As is apparent from the aforementioned description, since such judgment must be negative in the present situation, the procedure proceeds to the step S13.

Step S13 . . . A control pulse rate for shifting a position of the throttle valve to the primary position thereof on the complete firing is set, and at the same time this primary position on the complete firing (i.e., shifting target position of a pulse motor) Th 2 is set by utilizing the engine temperature read in the step S1 as a parameter. (This corresponds to the selection of the PPCF memory 21 and the second pulse rate setting memory 24 in FIGS. 3A–3C.) Then, the throttle valve is driven towards said target position at a shifting speed corresponding to the pulse rate selected herein.

Step S14 . . . It is decided whether or not the present position of the pulse motor is equal to the target position set in the preceding step S13. Until said present position becomes equal to said target position, the procedure circulates through a loop of the steps S14→S1→S2→S6→S12→S13→S14.

Step S15 . . . When the decision in the preceding step S14 has been concluded, the flag on the primary complete firing is set. Thereafter, the procedure returns to the step S1, and since all the judgments in the steps S2, S6 and S12 are positive, the procedure commences to proceed to step S16.

Step S16 . . . It is decided whether the flag on the secondary complete firing has been set or not. In the early stage, since the flag on the secondary complete firing has not yet been set, the procedure proceeds to step 17.

Step S17 . . . A control pulse rate for shifting a position of the throttle valve to the secondary position thereof on the complete firing is set, and at the same time this secondary position on the complete firing (i.e., shifting target position of the pulse motor) Th 3 is set by utilizing the engine temperature read in the step S1 as a parameter. (This corresponds to the selection of the SPCF memory 22 and the third pulse rate setting memory 29 in FIGS. 3A-3C.)

Step S18 . . . It is decided whether or not the present position of the pulse motor is equal to the target position set in the preceding step S17. Until said present position becomes equal to said target position, the procedure circulates through a loop of the steps S18→S1→S2→S6→S12→S16→S17→S18.

Step S19 . . . When the decision in the preceding step S18 has been concluded, the flag on the secondary complete firing is set. Thereafter, the procedure returns to the step S1, and since all the judgment in the steps S2, S6, S12 and S16 are positive, the procedure commences to proceed to step 20.

Step S20 . . . A pulse rate for controlling the throttle valve under warming-up condition is set, and at the same time the secondary position on the complete firing (i.e., shifting target position of the pulse motor) is set by utilizing the engine temperature read in the step Sl as a parameter. (This corresponds to the selection of the SPCF memory 22 and the first pulse rate setting memory 28 in FIGS. 3A-3C.) Then, the throttle valve is driven towards said target position at a shifting speed corresponding to the pulse rate set in this step.

By way of the procedure as described above, starting control and complete firing control for opening angle of the throttle valve are completed, and the procedure shifts to warming-up control. That is, the precedure circulates thereafter through a loop of the steps S20→S1→S2→S6→S12→S16→S20.

As is clear from the above description, according to the present invention, when the engine reached the complete firing state, the throttle valve is rapidly closed from the starting position to the primary position on the complete firing or the intermediate position, and then the throttle valve is comparatively moderately closed to the final secondary position on the complete firing (warming-up position), so as to avoid a situation where air fuel ratio of a mixture decreases suddenly and remarkably, and occurrence of stall of the engine is prevented in the state of complete firing. Furthermore, immediately after the engine reached the complete firing, since the position of the throttle valve is rapidly closed to the primary position on the complete firing, the air fuel ratio of the mixture does not become excessive to cause plugs to be wetted.

What is claimed is:

1. An apparatus for controlling the opening angle of a throttle valve on complete firing comprising:

a throttle valve disposed in an intake barrel of a carburetor, a choke valve disposed upstream of said throttle valve, a motor for driving said throttle valve and said choke valve to control the respective opening angles of both the valves, means for detecting a temperature and a rotational speed of an engine, means for sensing when said engine has reached a state of complete firing, a starting position memory for storing the opening angle of said throttle valve at the time when said engine starts by utilizing temperature of said engine as a parameter, a memory for primary position of said throttle valve on the complete firing for storing said primary position as an intermediate position which lies between a starting position and a warming-up position after said engine has reached the complete firing state by utilizing the temperature of said engine as a parameter, a memory for secondary position of said throttle valve on the complete firing for storing said secondary position as a warming-up position after said engine has reached the complete firing state by utilizing the temperature of said engine as a parameter, at least one pulse rate setting memory for determining the speed at which said throttle valve shifts to each target opening angle, and means for comparing each target opening angle of said throttle valve with the existing opening angle thereof to drive said motor in response to the resulting deviation, the speed at which said throttle valve is shifted from said starting position to said intermediate primary position of the throttle valve on the complete firing being greater than the speed at which said throttle valve is shifted from said intermediate primary position to said warming-up secondary position on the complete firing.

2. An apparatus for controlling the opening angle of a throttle valve on complete firing as claimed in claim 1 wherein said shifting of the throttle valve from said starting position to said intermediate primary position is delayed by a predetermined period of time after said engine has reached the complete firing state.

3. An apparatus for controlling the opening angle of a throttle valve on complete firing as claimed in claim 2 wherein said delay time is a function of temperature of said engine, and said delay time is set in such a manner that a lower temperature provides a longer delay time.

* * * * *